US008869723B2

(12) United States Patent
Hasegawa et al.

(10) Patent No.: US 8,869,723 B2
(45) Date of Patent: Oct. 28, 2014

(54) EMBROIDERY FRAME TRANSPORT DEVICE AND SEWING MACHINE

(71) Applicants: Katsuhisa Hasegawa, Kitanagoya (JP); Midori Magara, Nagoya (JP); Masayuki Hori, Gifu (JP)

(72) Inventors: Katsuhisa Hasegawa, Kitanagoya (JP); Midori Magara, Nagoya (JP); Masayuki Hori, Gifu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 14/081,738

(22) Filed: Nov. 15, 2013

(65) Prior Publication Data

US 2014/0144361 A1 May 29, 2014

(30) Foreign Application Priority Data

Nov. 29, 2012 (JP) ..... 2012-260519

(51) Int. Cl.
*D05B 39/00* (2006.01)
*D05C 9/06* (2006.01)
*D05B 69/12* (2006.01)

(52) U.S. Cl.
CPC *D05C 9/06* (2013.01); *D05B 69/12* (2013.01); *D05B 69/125* (2013.01)
USPC ..... 112/470.18

(58) Field of Classification Search
CPC .... D05B 21/00; D05B 21/002; D05B 21/005; D05B 21/007; D05C 9/04; D05C 9/06
USPC ..... 112/102–103, 318, 322, 323, 470.06, 112/470.09, 470.14, 470.18
See application file for complete search history.

(56) References Cited

U.S. PATENT DOCUMENTS

| | | | | |
|---|---|---|---|---|
| 2,989,015 | A * | 6/1961 | Taketomi | 112/103 |
| 3,082,721 | A * | 3/1963 | Bono | 112/102 |
| 3,750,186 | A * | 7/1973 | Sakamoto | 346/33 MC |
| 4,411,208 | A * | 10/1983 | Nishida et al. | 112/103 |
| 4,419,945 | A * | 12/1983 | Nishina | 112/103 |
| 4,424,758 | A * | 1/1984 | Mikuni et al. | 112/103 |
| 4,598,655 | A * | 7/1986 | Takenoya | 112/103 |
| 5,048,435 | A * | 9/1991 | Takenoya et al. | 112/103 |
| 5,503,093 | A * | 4/1996 | Katou | 112/103 |
| 8,438,984 | B2 * | 5/2013 | Hasegawa et al. | 112/103 |
| 2013/0074748 | A1 | 3/2013 | Kato et al. | |
| 2013/0199430 | A1 | 8/2013 | Kato | |
| 2013/0291774 | A1 * | 11/2013 | Makover et al. | 112/102.5 |

FOREIGN PATENT DOCUMENTS

| | | |
|---|---|---|
| JP | A-05-123464 | 5/1993 |
| JP | A-2013-070875 | 4/2013 |
| JP | A-2013-158491 | 8/2013 |

* cited by examiner

*Primary Examiner* — Nathan Durham
(74) *Attorney, Agent, or Firm* — Oliff PLC

(57) ABSTRACT

An embroidery frame transport device includes a carriage and a first drive mechanism. The carriage rotatably supports an embroidery frame and that is capable of moving in a first direction. The first drive mechanism is provided separately from the carriage, that transports the carriage in the first direction and that causes the embroidery frame supported by the carriage to rotate.

7 Claims, 6 Drawing Sheets

EMBROIDERY FRAME TRANSPORT DEVICE AND SEWING MACHINE

CROSS-REFERENCE TO RELATED APPLICATION

This application claims priority to Japanese Patent Application No. 2012-260519, filed Nov. 29, 2012, the content of which is hereby incorporated herein by reference.

BACKGROUND

The present disclosure relates to an embroidery frame transport device that transports an embroidery frame and to a sewing machine on which the embroidery frame transport device can be mounted.

In related art, an embroidery frame transport device that transports an embroidery frame and a sewing machine on which the embroidery frame transport device can be mounted are known. For example, an automatic sewing machine that is provided with a holding portion is known. The holding portion is formed by a circular outer frame and an inner frame that fits into an inner side of the outer frame, and by a support frame that supports the outer frame and the inner frame. The holding portion can clamp an object on which sewing is performed (hereinafter referred to as a sewing object) between the outer frame and the inner frame and can hold the sewing object in a stretched horizontal state below a sewing needle. The automatic sewing machine is provided with 3 motors. One of the motors moves the holding portion in an X direction. Another of the motors moves the holding portion in a Y direction. Yet another of the motors is provided on the support frame of the holding portion. When the motor provided on the support portion rotates, the holding portion moves rotatingly in the horizontal direction.

SUMMARY

However, in the above-described automatic sewing machine of related art, the motor that causes the holding portion to rotate is provided on the support frame of the holding portion. As a result, the weight of the holding portion is significant. Therefore, when the automatic sewing machine moves the holding portion in the X direction and in the Y direction and then stops the holding portion, it is difficult to stop the holding portion. There is thus a case in which accuracy of a stop position of the holding portion deteriorates.

It is an object of the present disclosure to provide an embroidery frame transport device and a sewing machine that are capable of improving the accuracy of a stop position of the embroidery frame.

Various embodiments provide an embroidery frame transport device includes a carriage and a first drive mechanism. The carriage rotatably supports an embroidery frame and that is capable of moving in a first direction. The first drive mechanism is provided separately from the carriage, that transports the carriage in the first direction and that causes the embroidery frame supported by the carriage to rotate.

Embodiments also provide a sewing machine includes a bed portion. The bed portion is formed such that an embroidery frame transport device can be mounted thereon. The embroidery frame transport device includes a carriage that rotatably supports an embroidery frame and that is capable of moving in a first direction, and a first drive mechanism that is provided separately from the carriage, that transports the carriage in the first direction and that causes the embroidery frame supported by the carriage to rotate.

BRIEF DESCRIPTION OF THE DRAWINGS

Embodiments will be described below in detail with reference to the accompanying drawings in which.

DETAILED DESCRIPTION

Hereinafter, an embodiment of the present disclosure will be explained with reference to the drawings. The drawings referred to are used to explain technological features that can be adopted by the present disclosure and are not intended to limit the scope of the present disclosure. A configuration of a sewing machine 1 will be explained with reference to FIG. 1 to FIG. 3. The lower right side, the upper left side, the lower left side and the upper right side in FIG. 1 respectively correspond to the front side, the rear side, the left side and the right side of the sewing machine 1. The left-right direction of the sewing machine 1 is an X direction, and the front-rear direction is a Y direction (refer to FIG. 4).

Figure 1:
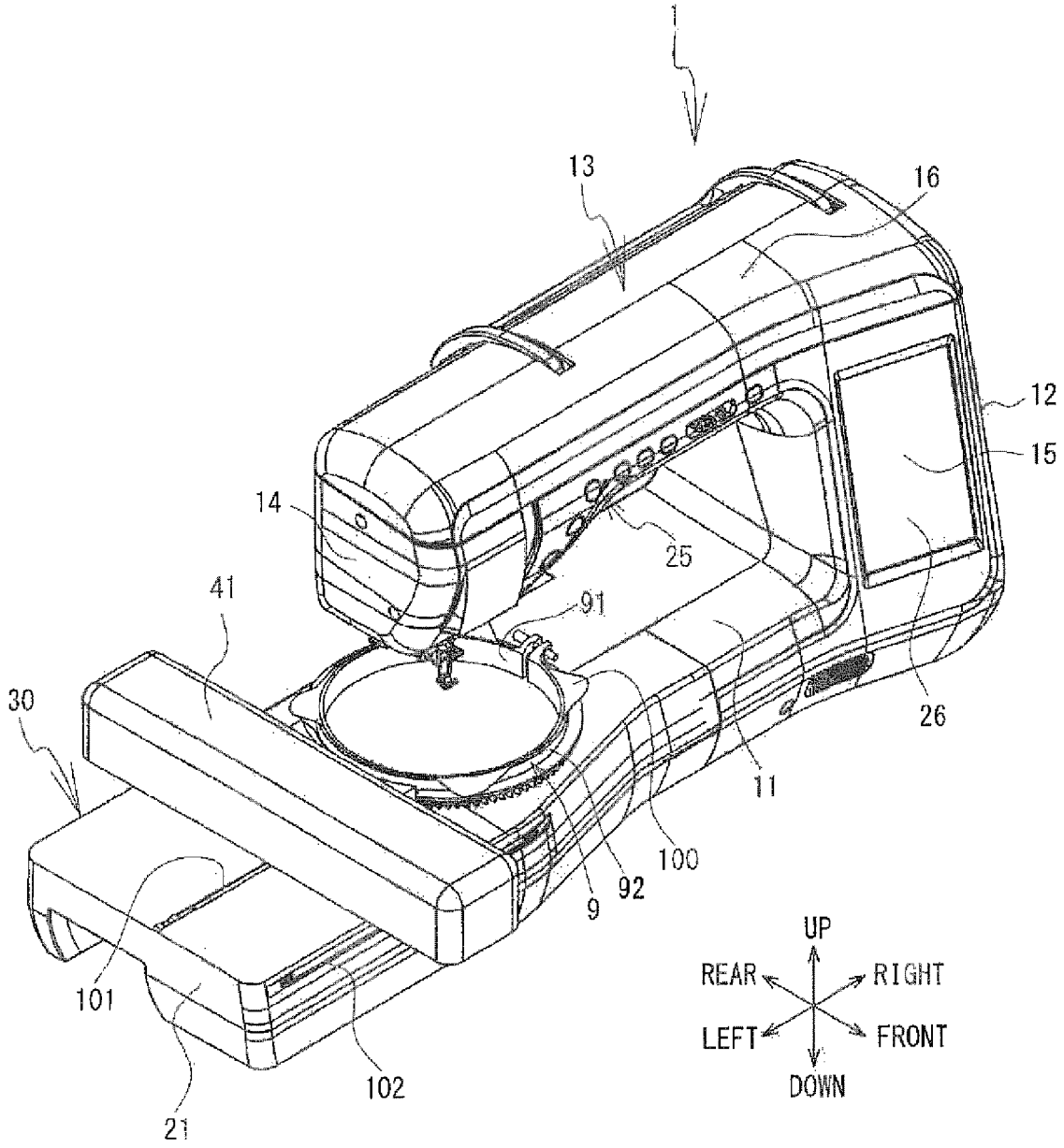
FIG. 1 is a perspective view of a sewing machine 1 on which an embroidery frame transport device 30 is mounted.

As shown in FIG. 1, the sewing machine 1 is provided with a bed portion 11, a pillar portion 12, an arm portion 13 and a head portion 14. The bed portion 11 is a base portion of the sewing machine 1 and extends in the left-right direction. The pillar portion 12 extends upward from the right end portion of the bed portion 11. The arm portion 13 extends to the left from the upper end of the pillar portion 12. The head portion 14 is provided on the left leading end portion of the arm portion 13. A needle plate (not shown in the drawings) is arranged on the top surface of the bed portion 11. A feed dog (not shown in the drawings), a cloth feed mechanism (not shown in the drawings), a feed amount adjustment pulse motor 78 (refer to FIG. 6) and a shuttle mechanism (not shown in the drawings) are provided inside the bed portion 11, underneath the needle plate. The feed dog may feed, by a specified feed amount, a work cloth on which sewing is performed. The cloth feed mechanism may drive the feed dog. The feed adjustment pulse motor 78 may adjust the feed amount.

When embroidery sewing or cut work (to be explained later) is performed by the sewing machine 1, an embroidery frame (an embroidery frame 9, for example), which holds a work cloth, is disposed on the top side of the bed 11. In the sewing machine 1, a sewable area inside the embroidery frame is set depending on a type of the embroidery frame that is mounted on an embroidery frame transport device 30. The embroidery frame transport device 30 that moves the embroidery frame 9 can be mounted on and removed from the bed portion 11.

A needle bar 6 (refer to FIG. 2) and the shuttle mechanism (not shown in the drawings) are driven while the embroidery frame 9 is moved in the X direction and the Y direction while being rotated by the embroidery frame transport device 30. In this manner, a pattern sewing operation, in which a specific embroidery pattern is sewn on a work cloth 100 that is held in the embroidery frame 9, and cut work, in which the work cloth 100 is cut into a specific shape, are performed. When a normal pattern that is not an embroidery pattern is sewn, the embroidery frame transport device 30 is removed from the bed portion 11. Then, normal sewing is performed while the work cloth 100 is fed by the feed dog. The embroidery frame transport device 30 will be explained in detail later.

As shown in FIG. 1, a vertically rectangular liquid crystal display 15 is provided on the front face of the pillar portion 12. Images of various types of items, such as a plurality of types of patterns, names of commands that cause various types of functions to be performed, and various types of messages may be displayed on the liquid crystal display 15. A transparent touch panel 26 is provided on the front face of the liquid crystal display 15. By using a finger or a special touch pen to touch a position on the touch panel 26 that corresponds to one of the items that are displayed on the liquid crystal display 15, a user can select a pattern to be sewn or a command to be executed.

The configuration of the arm portion 13 will be explained. A switch cluster 25, which includes a sewing start-and-stop switch etc., is provided in the lower part of the front face of the arm portion 13. An opening and closing cover 16 is provided in the top part of the arm portion 13. The opening and closing cover 16 is axially supported such that it can be opened and closed by being rotated about an axis that extends in the left-right direction at the upper rear edge of the arm portion 13. Underneath the opening and closing cover 16, that is, in the interior of the arm portion 13, a thread container portion (not shown in the drawings) is provided that contains a thread spool (not shown in the drawings) that supplies an upper thread. The upper thread that extends from the thread spool is supplied to a sewing needle that is not shown in the drawings, through a thread guard portion that includes a tensioner, a thread take-up spring, and a thread take-up lever that are not shown in the drawings. The tensioner is provided in the head portion 14 and may adjust the thread tension. The thread take-up lever may be driven reciprocally up and down and may pull the upper thread upward. A sewing needle (not shown in the drawings) or a cut work needle 8 (refer to FIG. 2) can be attached to a lower end of the needle bar 6 (refer to FIG. 2) that is provided on a lower portion of the head portion 14. The needle bar 6 may be driven by a needle bar up-and-down moving mechanism (not shown in the drawings) that is provided inside the head portion 14 so as to be moved up and down. The needle bar up-and-down moving mechanism may be driven by a drive shaft (not shown in the drawings) that may be rotationally driven by a sewing machine motor 79 (refer to FIG. 6). In other words, the needle bar 6 may be driven by the sewing machine motor 79.

Figure 2:
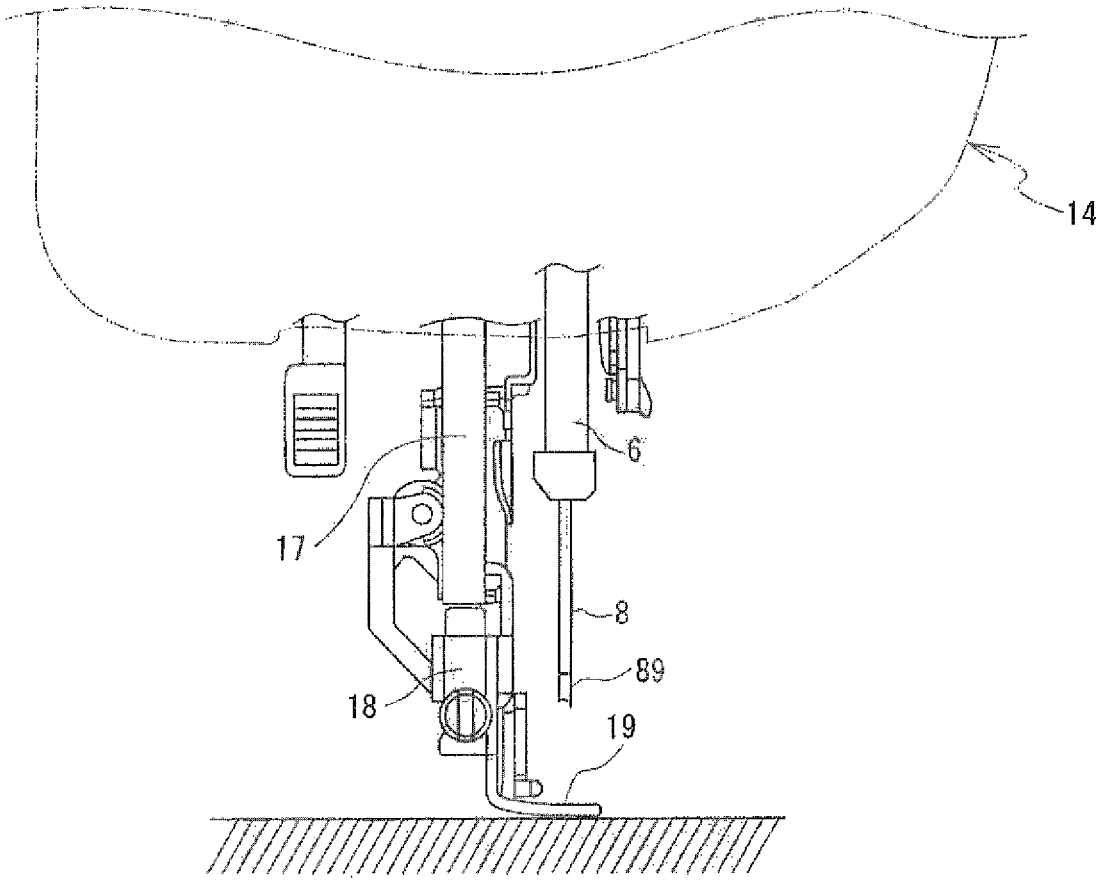
FIG. 2 is a diagram of a vicinity of a needle bar 6 on which a cutwork needle 8 is mounted, as seen from the left of the sewing machine.

As shown in FIG. 2, the cut work needle 8 is provided with a blade 89 that has a specified width in a specified direction (the front-rear direction in FIG. 2). When the sewing machine 1 uses the cut work needle 8 to perform the cut work, a cut that has a specified width is formed in the work cloth 100. When the cut work needle 8 is affixed to the lower end of the needle bar 6, the sewing machine 1 can perform the cut work. When the sewing needle (not shown in the drawings) is affixed to the lower end of the needle bar 6, the sewing machine 1 can perform the embroidery sewing. A presser bar 17 is provided to the rear of the needle bar 6. A presser holder 18 is attached to the lower end of the presser bar 17. A presser foot 19 that presses down on the work cloth 100 can be attached to and removed from the presser holder 18.

Figure 3:
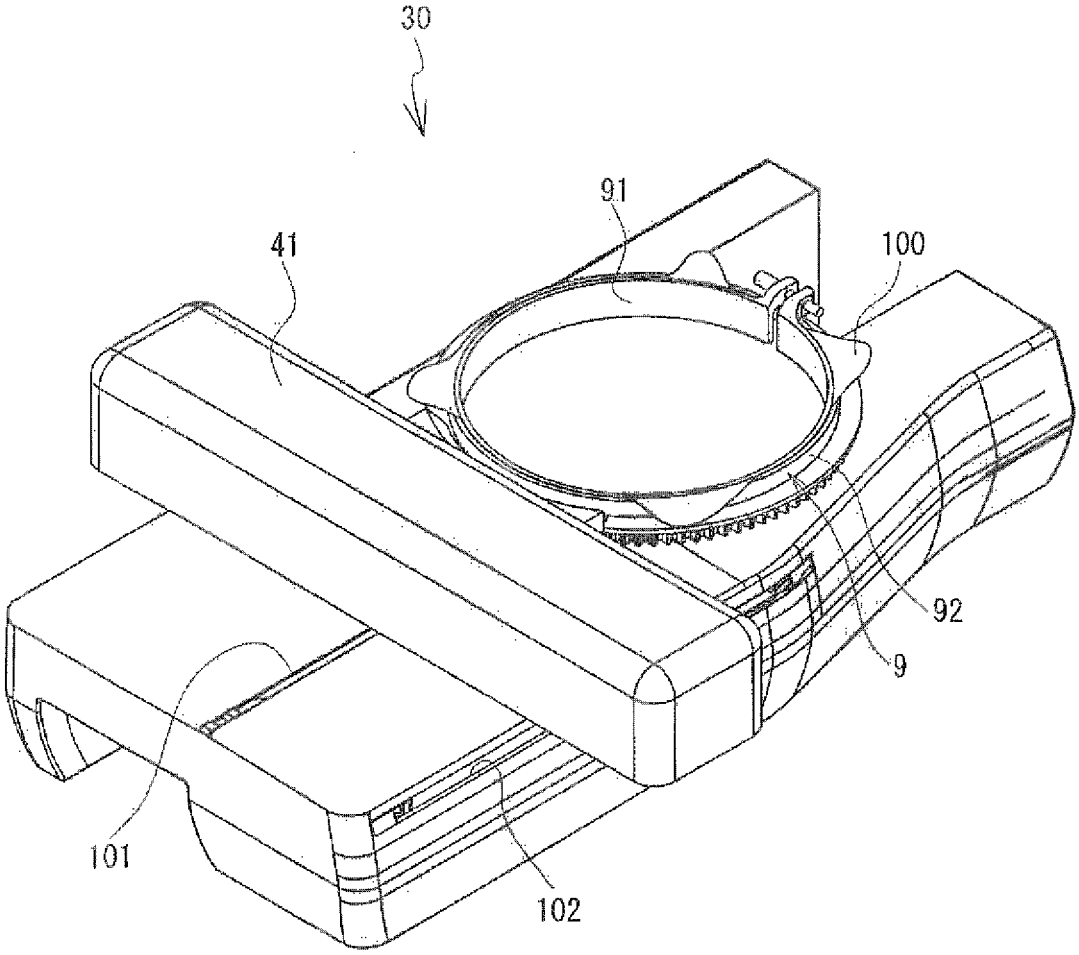
FIG. 3 is a perspective view of the embroidery frame transport device 30 in a state in which an embroidery frame 9 is mounted.

As shown in FIG. 1 and FIG. 3, the embroidery frame transport device 30 is provided with a case 21 having a smooth top surface, and a movable case 41 that that is disposed above the case 21 and that is long and thin in the front-rear direction and both ends at the front and rear of the movable case 41 overhang both ends of the case 21 at the front and rear. A slit 101 that extends in the left-right direction is provided in a center portion, in the front-rear direction, of the top surface of the case 21. A slit 102 that extends in the left-right direction is provided in an upper portion of the front surface of the case 21. A carriage 50 extends to the right from a first drive mechanism 45 (to be explained later, refer to FIG. 4) that is provided inside the movable case 41. The carriage 50 is disposed above the case 21. When the case 21 is mounted on the bed portion 11, the top surface of the case 21 and the top surface of the bed portion 11 have the same height. As will be explained in detail later, the embroidery frame 9 is mounted on the carriage 50.

The internal configuration of the movable case 41 and the carriage 50 will be explained in detail with reference to FIG. 4. A Y direction frame 44, the first drive mechanism 45, a part of the carriage 50, and a rotation amount detection portion 40 are arranged inside the movable case 41. The Y direction frame 44 extends in the Y direction and supports the first drive mechanism 45 and the rotation amount detection portion 40. The first drive mechanism 45 is provided separately from the carriage 50. The first drive mechanism 45 is a mechanism that transports the carriage 50 in the Y direction and that causes the embroidery frame 9 (to be explained later) supported by the carriage 50 to rotate.

The first drive mechanism 45 is provided with a first transport mechanism 46, a rotation mechanism 47, and a first motor 49. The first transport mechanism 46 is a mechanism that transports the carriage 50 in the Y direction. The rotation mechanism 47 is a mechanism that causes the embroidery frame 9 to rotate. The first motor 49 may drive the first transport mechanism 46 and the rotation mechanism 47.

The first motor 49 is disposed on a front portion of the Y direction frame 44. A drive shaft 491 of the first motor 49 extends to the rear, and is fixed by a screw to a wall portion 441 that extends upward from the front portion of the Y direction frame 44. The first motor 49 is electrically connected to a drive circuit 291 (refer to FIG. 6) of a base plate 29 via wiring 493. A drive gear 492 is attached to the rear end of the drive shaft 491. The first transport mechanism 46 and the rotation mechanism 47 are coupled to the drive gear 492.

The first transport mechanism 46 will be explained. The first transport mechanism 46 includes a first electromagnetic clutch 462 and a lead shaft 465. Although not shown in detail in the drawings, the first electromagnetic clutch 462 is fixed to the Y direction frame 44. The first electromagnetic clutch 462 is a clutch of a known configuration, and has a first drive gear 461. The first drive gear 461 is provided to the left side of the drive gear 492, and meshes with the drive gear 492. The diameter of the first drive gear 461 is larger than the diameter of the drive gear 492. The first electromagnetic clutch 462 is electrically connected to a drive circuit 293 (refer to FIG. 6) on the base plate 29 (to be explained later), via wiring 463.

A shaft portion 464 that has an outer diameter smaller than the outer diameter of the lead shaft 465 and that extends toward the front is provided integrally to the front of the lead shaft 465. The rear of the shaft portion 464 fits into a through hole (not shown in the drawings) of a hollow shaft (not shown in the drawings) that is provided inside the first electromagnetic clutch 462, and the shaft portion 464 is fixed to the hollow shaft such that the shaft portion 464 rotates in an integrated manner with the hollow shaft. The front end of the shaft portion 464 is coupled to a rotation shaft (not shown in the drawings) of a first encoder 401 (that will be explained later).

The lead shaft 465 is disposed to the rear of the first electromagnetic clutch 462. The lead shaft 465 extends in the front-rear direction. A wall portion 442 that extends upwardly from the Y direction frame 44 is provided to the rear of the first electromagnetic clutch 462. The wall portion 442 extends in the left-right direction. The rear end of the Y direction frame 44 is bent upward and forms a wall portion 443. The wall portion 443 extends in the left-right direction.

A bearing 467 is fixed to the surface of the wall portion 442 that faces the rear side of the first electromagnetic clutch 462. The bearing 467 rotatably supports the front end of the lead shaft 465. A bearing 468 is fixed to the wall portion 443, and rotatably supports the rear end of the lead shaft 465. Further, although not shown in detail in the drawings, the lead shaft 465 is supported by the bearing 467 such that the lead shaft 465 cannot move in the axial direction. A helical groove portion 466 is formed in the outer peripheral surface of the lead shaft 465. When the lead shaft 465 supports the carriage 50 and is rotated by the driving of the first motor 49, the carriage 50 moves in the Y direction, as will be explained in more detail later.

The first electromagnetic clutch 462 has a coil (not shown in the drawings) inside. When the coil is energized via the wiring 463, the first drive gear 461 and the hollow shaft are coupled. The hollow shaft is fixed such that it rotates in an integrated manner with the shaft portion 464, and thus generates a state in which the first drive gear 461 and the lead shaft 465 rotate in an integrated manner. Further, when the conduction of the electric current to the coil is stopped, the coupling between the first drive gear 461 and the hollow shaft is released. In the above-described state, even when the first drive gear 461 rotates, the lead shaft 465 does not rotate. Specifically, the first electromagnetic clutch 462 switches between the transmission of and the shutting off of a rotary force resulting from the driving of the first motor 49, and thus controls the rotation or the stopping of the lead shaft 465.

The rotation mechanism 47 will be explained in detail. The rotation mechanism 47 includes a second electromagnetic clutch 472, a spline shaft 475, bushes 83 and a worm 81. Although not shown in detail in the drawings, the second electromagnetic clutch 472 is fixed to the Y direction frame 44. The second electromagnetic clutch 472 is a clutch having the same configuration as the first electromagnetic clutch 462, and has a second drive gear 471. The second drive gear 471 is provided to the right side of the drive gear 492, and meshes with the drive gear 492. The diameter of the second drive gear 471 is the same size as the diameter of the first drive gear 461. The second electromagnetic clutch 472 is electrically connected to a drive circuit 294 (refer to FIG. 6) on the base plate 29 (to be explained later), via wiring 473.

A shaft portion 474 that has an outer diameter smaller than the outer diameter of the spline shaft 475 and that extends toward the front is provided integrally to the front of the spline shaft 475. The rear of the shaft portion 474 fits into a through hole (not shown in the drawings) of a hollow shaft (not shown in the drawings) that is provided inside the second electromagnetic clutch 472, and the shaft portion 474 is fixed to the hollow shaft such that the shaft portion 474 rotates in an integrated manner with the hollow shaft. The front end of the shaft portion 474 is coupled to a rotation shaft (not shown in the drawings) of a second encoder 402 (that will be explained later).

The second electromagnetic clutch 472 operates in the same manner as the above-described first electromagnetic clutch 462, and switches between the transmission of and the shutting off of the rotary force resulting from the driving of the first motor 49, and thus controls the rotation and the stopping of the spline shaft 475.

The spline shaft 475 is provided to the rear of the second electromagnetic clutch 472. The spline shaft 475 is disposed in parallel to the lead shaft 465. On the outer periphery of the spline shaft 475, four flat surface portions are formed at 90 degree intervals. A cross section of the spline shaft 475 taken perpendicularly to the axial direction has a shape in which four square corner portions look as if they have been R-chamfered (corner surfaces have been chamfered) (refer to FIG. 5). The cross section shape of the spline shaft 475 is hereinafter referred to as a substantially square shape.

A bearing 477 is fixed to the surface of the wall portion 442 that faces the rear side of the second electromagnetic clutch 472. The bearing 477 rotatably supports the front end of the spline shaft 475. A bearing 478 is fixed to the wall portion 443, and rotatably supports the spline shaft 475. Further, although not shown in detail in the drawings, the spline shaft 475 is supported by the bearing 477 such that the spline shaft 475 cannot move in the axial direction. The spline shaft 475 supports the carriage 50 (to be explained later) such that it can move in the front-rear direction.

The worm 81 and the two bushes 83 engage with the spline shaft 475 such that they can move in the axial direction and such that they rotate along with the rotation of the spline shaft 475. The worm 81 has a cylindrical shape that extends in the front-rear direction, and has helical teeth on its outer peripheral surface. The worm 81 meshes with a worm wheel 82 (to be explained later) that is rotatably supported on the carriage 50. The worm 81 and the worm wheel 82 form a worm gear 80. The shape of a hole 811 (refer to FIG. 5) on the inner side of the cylindrically-shaped worm 81 is formed as a substantially square shape such that the spline shaft 475 can be slidingly inserted through the hole. The bushes 83 are arranged such that they sandwich the worm 81 from the front and the rear. The shape of a hole 833 (refer to FIG. 5) in the inner side of each of the bushes 83 is formed as a substantially square shape such that the spline shaft 475 can be slidingly inserted through the hole.

Each of the bushes 83 is formed of a small diameter portion 831 and a large diameter portion 832 having a larger diameter than the small diameter portion 831. The worm 81 and the large diameter portions 832 of the two bushes 83, are disposed on the inner side of an rectangular-shaped opening 515 provided on the carriage 50 (refer to FIG. 5). The smaller diameter portions 831 of the bushes 83 are disposed such that they fit rotatably into hole portions 517 formed respectively in front and rear wall portions of the opening 515. The shape of the carriage 50 will be explained later.

The worm 81 and the bushes 83 move in the Y direction in collaboration with the carriage 50 that is transported by the rotation of the lead shaft 465. Further, the worm 81 and the bushes 83 rotate in accordance with the rotation of the spline shaft 475. The worm 81 rotates in accordance with the rotation of the spline shaft 475 and this will be explained in more detail later.

The rotation amount detection portion 40 will be explained. The rotation amount detection portion 40 detects a rotation amount of the lead shaft 465 and the spline shaft 475, respectively. The rotation amount detection portion 40 includes the first encoder 401 and the second encoder 402. The first encoder 401 and the second encoder 402 are known rotary encoders. The front end portion of the Y direction frame 44 is bent upward and forms the wall portion 445. The first encoder 401 and the second encoder 402 are fixed to the wall portion 445. The first encoder 401 is electrically connected to wiring (not shown in the drawings) of the base plate 29, via wiring 403. The second encoder 402 is electrically connected to wiring (not shown in the drawings) of the base plate 29, via wiring 404.

The first encoder 401 detects the rotation amount of the lead shaft 465, by detecting the rotation amount of the shaft portion 464 that is formed integrally with the lead shaft 465. The second encoder 402 detects the rotation amount of the spline shaft 475, by detecting the rotation amount of the shaft portion 474 that is integrally formed with the spline shaft 475. The rotation amounts detected by the first encoder 401 and the second encoder 402 are transmitted to a CPU 61 (refer to FIG. 6) that is provided in the sewing machine 1, via the wiring 403 and 404 and the base plate 29 etc. Based on detection results of the rotation amounts detected by the first encoder 401 and the second encoder 402, the CPU 61 controls a rotation amount of the first motor 49, and thus controls the rotation amounts of the lead shaft 465 and the spline shaft 475. By the above-described processing, the first motor 49 controls the transport and the stopping of the carriage 50 in the Y direction, and controls the rotation and rotation cessation of the embroidery frame 9.

The carriage 50 will be explained with reference to FIG. 4 and FIG. 5. The lower left side, the upper right side, the lower right side and the upper left side in FIG. 5 respectively correspond to the left side, the right side, the front side and the rear side of the carriage 50. The carriage 50 is provided with an attachment portion 51 and an outer frame portion 54. The outer frame portion 54 is circular and rotatably supports the embroidery frame 9 that will be explained later. A support portion 541 (refer to FIG. 5), which protrudes to the inner side in the radial direction around the whole circumference of the outer frame portion 54, is provided on an inner peripheral side surface of the lower edge of the outer frame portion 54. The outer frame portion 54 supports the embroidery frame 9 by the support portion 541 supporting a middle frame 92 (to be explained later) of the embroidery frame 9.

The attachment portion 51 is provided on the left side of the outer frame portion 54. Protruding portions 511 that protrude to the left are provided, respectively, on the front and rear ends of the left side portion of the attachment portion 51. Circular hole portions 512 (refer to FIG. 5) that penetrate the protruding portions 511 in the front-rear direction are provided in each of the protruding portions 511. The lead shaft 465 is inserted through each of the hole portions 512. With the above-described configuration, the carriage 50 is in a state of being supported by the lead shaft 465 (refer to FIG. 4). The hole portions 512 can slide along the lead shaft 465 in the front-rear direction. A pin 514 that protrudes to the left is provided in a center portion of a wall surface 513 between the two protruding portions 511. The left end (the leading end) of the pin 514 engages with the groove portion 466 of the lead shaft 465 (refer to FIG. 4).

The opening 515 that penetrates in a rectangular shape in the up-down direction is provided in the center portion, in the front-rear direction and the in the left-right direction, of the attachment portion 51. Of wall portions 516 that form the opening 515, hole portions 517 that are long in the left-right direction are provided in front and rear wall surfaces (refer to FIG. 5). Parallel surfaces that extend in the left-right direction are formed on the top and bottom of inner walls of the hole portions 517. Note that only the hole portion 517 on the rear side is illustrated in FIG. 5, and the hole portion 517 on the front side is not illustrated. Of side walls 518 in the front-rear direction of the attachment portion 51, hole portions 519 that have the same shape as the hole portions 517 are provided in portions located to the front and to the rear of the hole portions 517 (refer to FIG. 5). Note that, in FIG. 5, only the hold portion 519 on the front side is illustrated and the hole portion 519 on the rear side is not illustrated. The center of the two hole portions 517 and the center of the two hole portions 519 are each positioned on the same straight line. The same straight line is parallel to a center line, which is a straight line passing through the center of the two hole portions 512.

The worm 81 and the bushes 83 that can be slidingly supported on the spline shaft 475 are disposed in the opening 515. The outer peripheral surface of each of the small diameter portions 831 of the bushes 83 comes into contact with a parallel plane in the up-down direction of the inner wall of each of the hole portions 517. With the above-described configuration, the carriage 50 is supported by the spline shaft 475 via the bushes 83. In addition, the spline shaft 475 and the hole portions 519 are assembled such that there is a gap between the spline shaft 475 and the hole portions 519. As a result of the above-described configuration, even when the spline shaft 475 rotates, the spline shaft 475 does not come into contact with the inner walls of the hole portions 519. When the carriage 50 is moved in the Y direction, the wall portions 516 that form the opening 515 push the side surface of each of the large diameter portions 832 of the bushes 83, and the bushes 83 and the worm 81 move.

Figure 4:
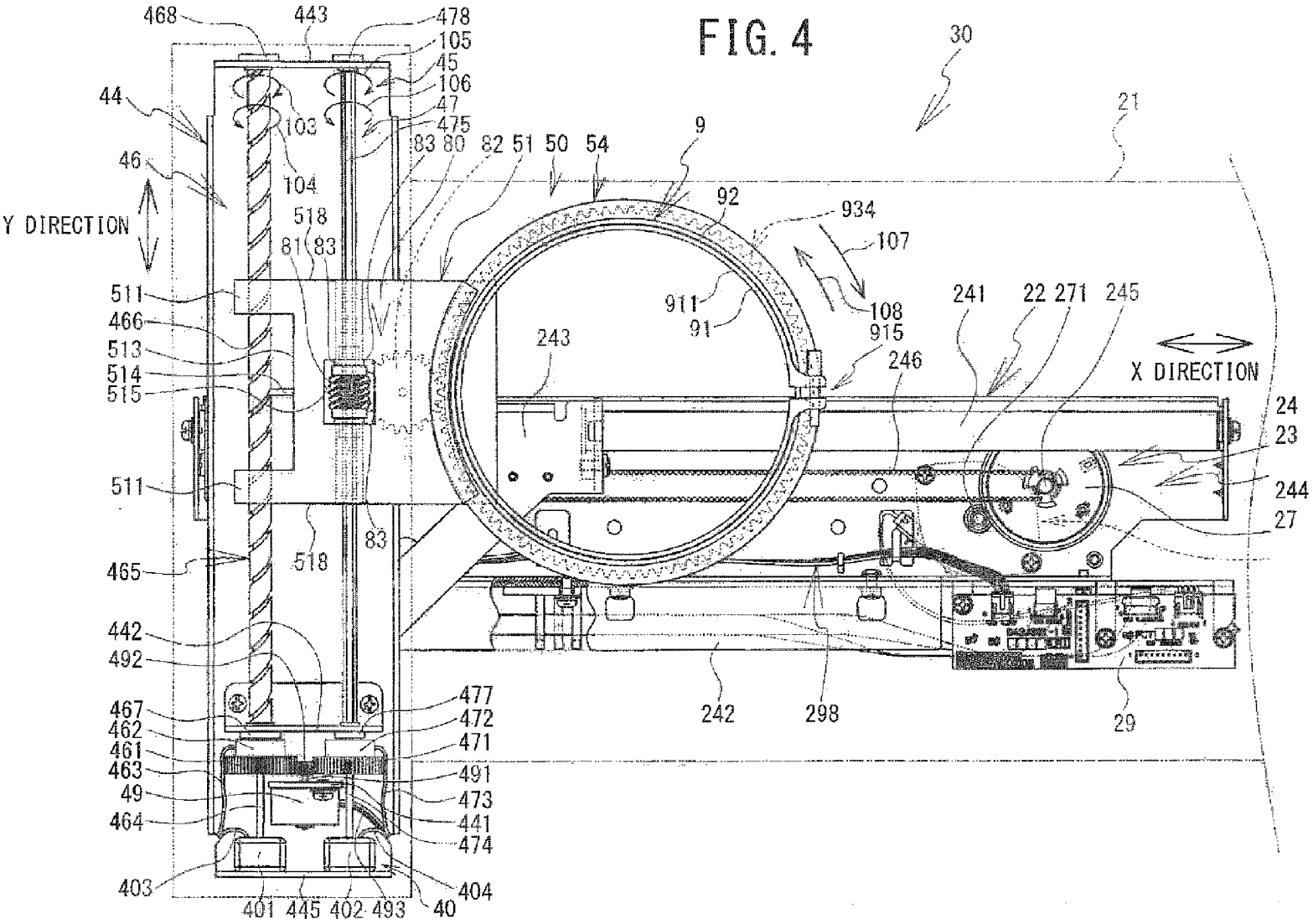
FIG. 4 is a diagram showing an internal configuration of the embroidery frame transport device 30.

The worm wheel 82 is rotatably supported on the inner side of the attachment portion 51, on the right side of the opening 515 (refer to FIG. 4). Of the walls 516 that form the opening 515, a rectangular hole portion 520, which is long in the front-rear direction, is provided in the side wall on the right side (refer to FIG. 5). The left end portion of the worm wheel 82 is exposed on the inner side of the opening 515 from the hole portion 520. As described above, the worm wheel 82 meshes with the worm 81 that is disposed in the opening 515, thus forming the worm gear 80.

A hole portion (not shown in the drawings) that penetrates in the left-right direction is provided in the center, in the front-rear direction, of a connection portion between the attachment portion 51 and the outer frame portion 54. The right end portion of the worm wheel 82 is exposed on the inner side of the outer frame portion 54 from the hole portion. The right end portion of the worm wheel 82 meshes with a frame gear 934 (to be explained later) that is formed on the outer peripheral surface of the embroidery frame 9 (more specifically, of the middle frame 92) (refer to FIG. 4).

The embroidery frame 9 will be explained. In the following explanation, the up-down direction on paper in FIG. 5 is the up-down direction of the embroidery frame 9. As shown in FIG. 4 and FIG. 5, the embroidery frame 9 is formed by assembling an inner frame 91 and the middle frame 92, both of which are a circular frame shape. In the embroidery frame 9, the middle frame 92 is disposed on the outer side, in the radial direction, of the inner frame 91 (refer to FIG. 4). The embroidery frame 9 clamps a work cloth 100 between the inner frame 91 and the middle frame 92 (refer to FIG. 1 and FIG. 3). The embroidery frame 9 is disposed on the inner side, in the radial direction, of the outer frame portion 54 of the carriage 50, and is configured such that the embroidery frame 9 can rotate with respect to the outer frame portion 54.

The inner frame 91 is provided with a circular frame portion 911. The frame portion 911 has a thickness in the axial direction and the radial direction. The inner frame 91 is provided with an adjustment portion 915 that can adjust the size of the diameter of the inner frame 91. The size of the diameter of the inner frame 91 is adjusted depending on the cloth thickness of the work cloth 100 clamped between the inner frame 91 and the middle frame 92. The adjustment portion 915 is provided with a parting portion 916, a pair of screw mounting portions 917 and an adjusting screw 918. The parting portion 916 is a portion at which a part of the parting portion 916 is discontinuous through the axial direction with respect to the circumferential direction of the frame portion 911 of the inner frame 91. The pair of screw mounting portions 917 are provided on an upper portion on both sides of the parting portion 916 on the frame portion 911, and protrude on the outer side in the radial direction such that they face each other. Hole portions 9171 and 9172 are provided in the pair of screw mounting portions 917, and the hole portions 9171 and 9172 penetrate in a direction that is orthogonal to a facing surface of the screw attachment portions 917. Of the two hole portions 9171 and 9172, a nut (not shown in the drawings), in which a screw hole is formed, is embedded in the one hole portion 9172 (the hole portion on the lower right side in FIG. 5).

The adjusting screw 918 is a screw member that is provided with a head portion 9181, which has a large diameter and which can be rotated by the user grasping it with his or her fingers, and with a shaft portion 9183 that has a small diameter and that extends integrally from the head portion 9181. A male screw portion 9182 is formed around a portion toward the leading end of the shaft portion 9183. A fine groove 9184, to which a retaining ring 9185 can be attached, is formed on a portion of the shaft portion 9183 toward the side of the head portion 9181. The adjusting screw 918 is mounted such that the shaft portion 9183 penetrates through the hole portion 9171 and the male screw portion 9182 is screwed into the nut embedded in the hole portion 9172. In the above-described state, by the retaining ring 9185 being attached to the fine groove 9184 of the shaft portion 9183, the adjusting screw 918 is held such that it can rotate around the screw mounting portion 917 on the side of the hole portion 9171 and, at the same time, is not able to move in the axial direction. When the user grips the head portion 9181 of the adjusting screw 918 with his or her fingers and performs a rotating operation, the screw mounting portion 917 on the side of the hole portion 9172 moves in the axial direction of the shaft portion 9183, via the nut. Further, the above-described movement direction is determined by the rotation direction of the adjusting screw 918. In this manner, in addition to connecting the pair of screw mounting portions 917, the adjusting screw 918 adjusts a gap between the pair of screw mounting portions 917 such that it increases or decreases. Then, by adjusting the gap between the pair of screw mounting portions 917, the size of the diameter of the inner frame 91 is adjusted in accordance with the cloth thickness of the work cloth 100. For example, the narrower the gap between the pair of screw mounting portions 917, the smaller the size of the diameter of the inner frame 91 becomes, and the work cloth 100 having a thicker cloth thickness can be clamped between the middle frame 92 and the inner frame 91. It should be noted that the retaining ring 9185 is omitted from the drawings apart from FIG. 5.

The middle frame 92 is provided with a circular frame portion 921 that has a larger inner diameter than the outer diameter of the frame portion 911 of the inner frame 91. The middle frame 92 is attached to and removed from the inner frame 91 by attaching or removing the frame portion 921 of the middle frame 92 to and from the outside of the frame portion 911 of the inner frame 91 in the radial direction. The frame gear 934, which is a cog formed around the whole circumference of the outer periphery surface, is formed on the lower end portion of the frame portion 921 of the middle frame 92. The frame gear 934 meshes with the worm wheel 82 provided on the carriage 50.

A flange portion 929 is provided in a central portion, in the axial direction, of the outer peripheral side surface of the frame portion 921 and on the upper side of the frame gear 934. The flange 929 protrudes toward the outside, in the radial direction, around the whole circumference of the frame portion 921. A support portion 936 is provided on the inner peripheral side surface at the lower edge of the frame portion 921. The support portion 936 protrudes toward the inside, in the radial direction, and is provided around the whole circumference of the frame portion 921. The support portion 936 is a portion that supports the lower edge surface of the inner frame 91.

The internal configuration of the case 21 will be explained with reference to FIG. 4. An X direction frame 22, a second drive mechanism 23 and the base plate 29 etc. are arranged inside the case 21. The X direction frame 22 has a specific width toward the front from a central portion, in the front-rear direction, inside the case 21, and extends in the left-right direction (the X direction). The X direction frame 22 supports the second drive mechanism 23 and the base plate 29.

The second drive mechanism 23 is a mechanism to transport the first drive mechanism 45 in the X direction by transporting the Y direction frame 44 in the X direction. More specifically, the second drive mechanism 23 is provided with a second transport mechanism 24 and a second motor 27. The second transport mechanism 24 is a mechanism to transport the first transport mechanism 46 in the X direction. The second motor 27 may drive the second transport mechanism 24.

The second transport mechanism 24 includes a guide shaft 241, a guide member 242, an auxiliary frame 243, a large diameter gear 244, a pulley 245 and a timing belt 246. The guide shaft 241 is provided on a rear portion of the X direction frame 22 and is long in the left-right direction. Both end portions of the guide shaft 241 are fixed to both sides on the left and the right of wall portions of the X direction frame 22. The guide member 242 is connected to a wall portion of the front end of the X direction frame 22. The guide member 242 has a specific width in the front-rear direction and extends in the left-right direction.

The auxiliary frame 243 is disposed above the guide shaft 241 and the guide member 242. The auxiliary frame 243 is a substantially triangular shape, and has a portion extending in the left-right direction along the guide shaft 241 and a portion extending diagonally to the left and to the front from the right end of the portion extending along the guide shaft 241. The auxiliary frame 243 is supported by the guide shaft 241 and the guide member 242 such that it can slide in the left-right direction. The rear end portion of the auxiliary frame 243 is formed such that it extends upward. The rear end portion of the auxiliary frame 243 protrudes upward from the slit 101 (refer to FIG. 1) and is connected to the Y direction frame 44. The front end portion of the auxiliary frame 243 is formed such that, after protruding to the front from the slit 102 (refer to FIG. 1), it extends upward and is connected to the Y direction frame 44.

The second motor 27 is fixed below the bottom of the front right portion of the X direction frame 22 such that a drive shaft thereof (not shown in the drawings) protrudes upward. The drive shaft of the second motor 27 is inserted through the bottom portion of the X direction frame 22 to the upper side. A drive gear 271 is affixed to the upper end of the drive shaft. The large diameter gear 244 and the pulley 245, which are integrally formed, are rotatably provided on a right portion of the X direction frame 22. The large diameter gear 244 meshes with the drive gear 271. A pulley that is not shown in the drawings is rotatably supported on a left portion of the X direction frame 22. The endless timing belt 246 is stretched over this pulley and over the pulley 245. The timing belt 246 is disposed between the guide shaft 241 and the guide member 242. A part of the timing belt 246 is coupled to the auxiliary frame 243. When the timing belt 246 moves, the auxiliary frame 243 is transported in the X direction and the Y direction frame 44 is transported in the X direction.

The base plate 29 is connected to the front right portion of the X direction frame 22. The drive circuit 291, a drive circuit 292, a drive circuit 293 and a drive circuit 294 (refer to FIG. 6) and a connector etc. (not shown in the drawings) are mounted on the base plate 29. A wiring group 298 that includes the wiring 403, 404, 463 and 473 is inserted through the slit 101 (refer to FIG. 1) and is connected to the base plate 29.

Figure 6:
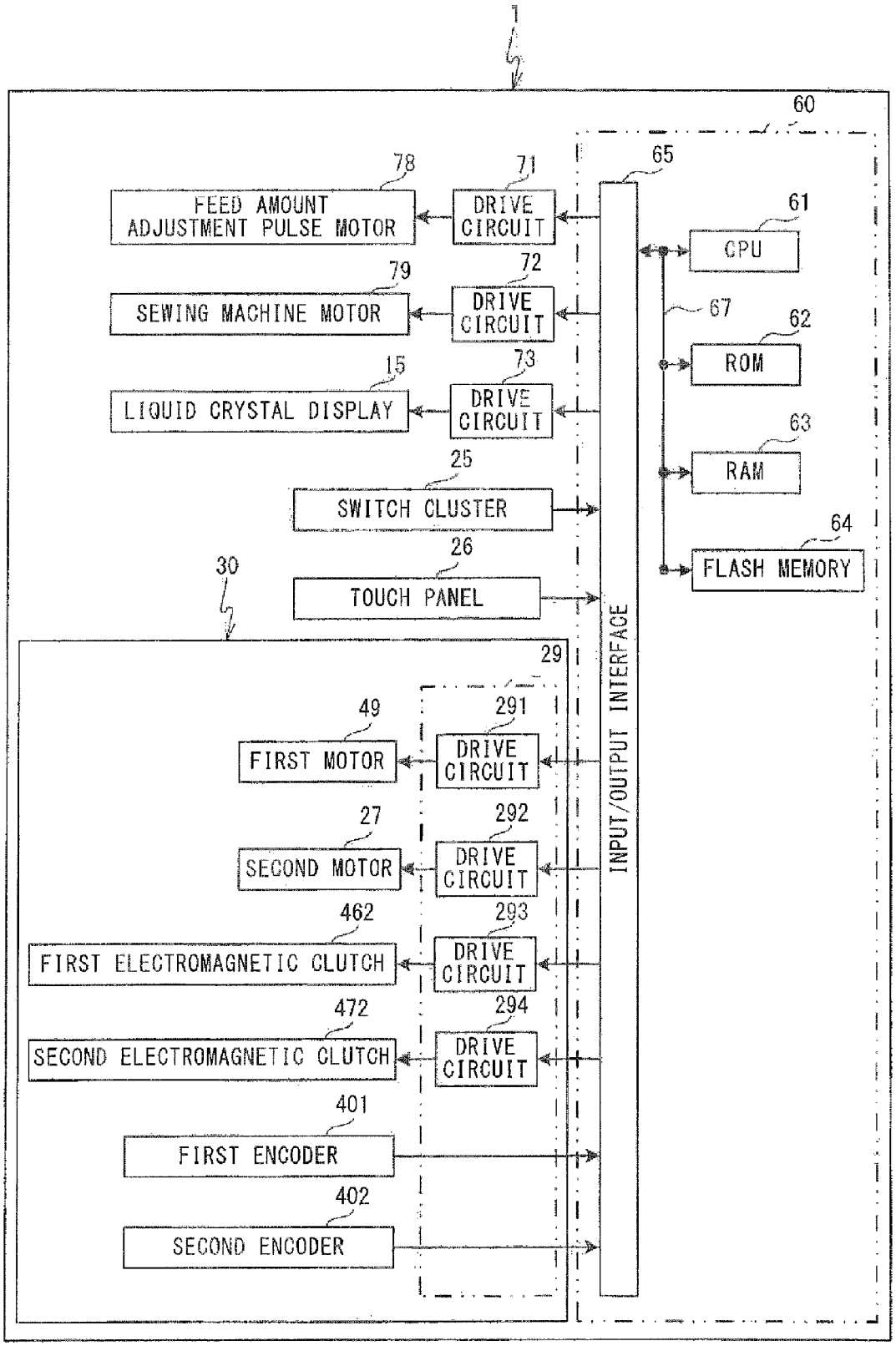
FIG. 6 is a block diagram showing an electrical configuration of the sewing machine 1.

The electrical configuration of the sewing machine 1 will be explained with reference to FIG. 6. As shown in FIG. 6, a control portion 60 of the sewing machine 1 is provided with a CPU 61, a ROM 62, a RAM 63, a flash memory 64 and an input/output interface 65, which are mutually connected via a bus 67. Program data etc. used for the CPU 61 to perform processing may be stored in the ROM 62. A plurality of embroidery data and cut work data etc. that will be explained later, which are used for the sewing machine 1 to perform embroidery sewing, and various data are stored in the flash memory 64.

The switch cluster 25, the touch panel 26, drive circuits 71 to 73, the drive circuits 291 to 294, the first encoder 401 and the second encoder 402 are electrically connected to the input-output interface 65. The drive circuit 71 drives the feed amount adjustment pulse motor 78. The drive circuit 72 drives the sewing machine motor 79. The drive circuit 73 may drive the liquid crystal display 15. The drive circuits 291 to 294 are mounted on the base plate 29 of the embroidery frame transport device 30. When the embroidery frame transport device 30 is connected to a main body of the sewing machine 1, the drive circuits 291 to 294, the first encoder 401 and the second encoder 402 are connected to the input-output interface 65 via connectors that are not shown in the drawings. The drive circuit 291 may drive the first motor 49. The drive circuit 292 may drive the second motor 27. The drive circuit 293 may drive a first electromagnetic clutch 462. The drive circuit 294 may drive the second electromagnetic clutch 472.

Figure 5:
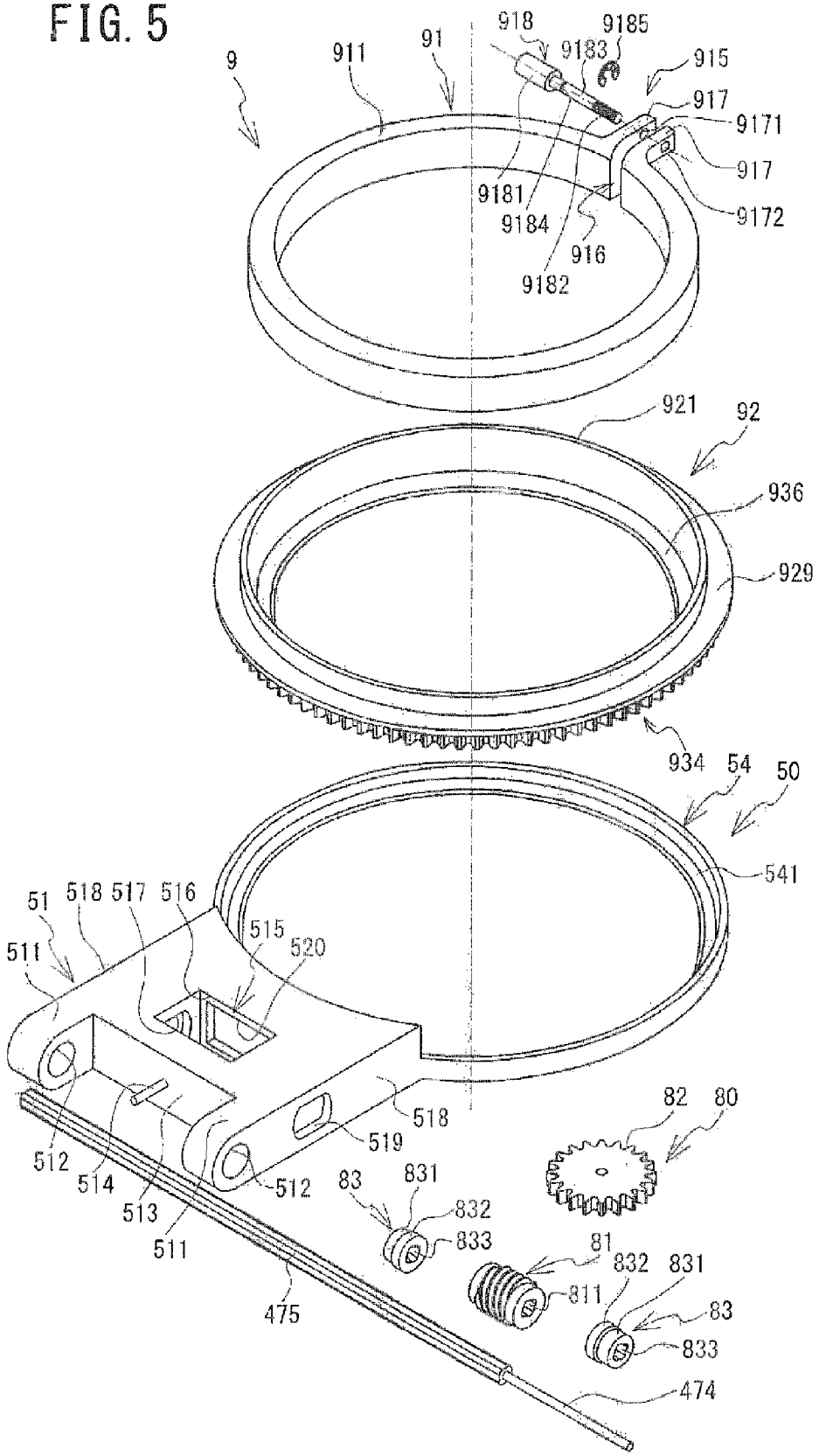
FIG. 5 is an exploded perspective view of a carriage 50 and the embroidery frame 9.

With reference to FIG. 4 and FIG. 5, an operation will be explained in which the carriage 50 is transported and the embroidery frame 9 is rotated while the work cloth 100 is clamped by the embroidery frame 9. First, the user places the middle frame 92 on a work table (not shown in the drawings) such that the frame gear 934 is on the downward side. Then, the user presses the work cloth 100 downward using the lower edge of the inner frame 91 and inserts the inner frame 91 into the inside of the middle frame 92, thus clamping the work cloth 100 between the inner frame 91 and the middle frame 92 (refer to FIG. 1 and FIG. 3). When clamping the work cloth 100, the user adjusts the size of the diameter of the inner frame 91 depending on the cloth thickness of the work cloth 100 by appropriately rotating the adjusting screw 918. In the state in which the work cloth 100 is clamped, the surface of the work cloth 100 on which the sewing is performed is in a state of being stretched on the inside of the inner frame 91 on the lower edge of the inner frame 91. The inner frame 91 and the middle frame 92 are assembled by the above-described configuration and the completed embroidery frame 9 is obtained.

Next, the user sets the embroidery frame 9 on the outer frame portion 54 of the carriage 50 from above the outer frame portion 54. When setting the embroidery frame 9 on the outer frame portion 54, the user places the embroidery frame 9 on the outer frame portion 54 such that the frame gear 934 and the worm wheel 82 of the carriage 50 mesh with each other. With the above-described configuration, the frame gear 934 and the worm wheel 82 are meshed with each other and the rotation of the embroidery frame 9 with respect to the outer frame portion 54 is thus stopped.

The blade 89 of the cut work needle 8 has the specific width in the front-rear direction (refer to FIG. 2). As a result of the above-described configuration, the direction of the cut formed in the work cloth 100 by the cut work needle 8 is the front-rear direction. Thus, in order to cut out a specified pattern in the work cloth 100 along a pattern-shaped contour, as well as moving the embroidery frame 9 in the X direction and the Y direction, it is necessary to rotate the embroidery frame 9 and change the direction of the cuts formed in the work cloth 100. Cut work data, which is used to create a specified pattern etc. by the sewing machine 1 cutting the work cloth 100, is stored in the flash memory 64 of the sewing machine 1. In the cut work data, data of a variable N, frame rotation data, X coordinates and Y coordinates are associated with each other. The variable N is a variable that indicates an order of cutting the work cloth 100. The frame rotation data is data of a rotation angle of the embroidery frame 9 with respect to the outer frame portion 54 that is set in advance. The X coordinates and the Y coordinates are coordinates of needle drop points (points at which the cut work needle 8 pierces the work cloth 100) in an embroidery coordinate system that is unique to the sewing machine 1 and that is set in advance. The CPU 61 of the sewing machine 1 controls the embroidery frame transport device 30, moves the embroidery frame 9 to the coordinates (X coordinates and Y coordinates) of the respective needle drop points and rotates the embroidery frame 9 by the rotation angle represented by the frame rotation data, in the order of the variable N of the cut work data. The CPU 61 drives the sewing machine motor 79 and thus drives the needle bar 6 (refer to FIG. 2), and forms the cuts by the cut work needle 8 (refer to FIG. 2) in the work cloth 100.

The X coordinate and the Y coordinate of a current needle drop point, and a current rotation angle of the embroidery frame 9 are stored in the RAM 63. The CPU 61 determines a rotation amount of the second motor 27 such that the Y direction frame 44 that supports the carriage 50 is transported by the difference between the X coordinate of the current needle drop point and the X coordinate of the next needle drop point. The CPU 61 determines a rotation amount of the lead shaft 465, namely a rotation amount of the first motor 49, such that the carriage 50 is transported by the difference between the Y coordinate of the current needle drop point and the Y coordinate of the next needle drop point. Further, the CPU 61 determines a rotation amount of the spline shaft 475, namely a rotation amount of the first motor 49, such that the embroidery frame 9 rotates by the difference between a current rotation angle of the embroidery frame 9 and a next rotation angle. The CPU 61 causes the second motor 27 and the first motor 49 to rotate by the determined rotation amounts and transports the embroidery frame 9 in the X direction and in the Y direction. Further, the CPU 61 causes the first motor 49 to rotate by the determined rotation amount and thus causes the embroidery frame 9 to rotate. Hereinafter, the rotation amounts of the second motor 27 and the first motor 49 determined by the CPU 61 are collectively referred to as a "determined rotation amount."

An operation of the embroidery frame transport device 30 when the carriage 50 and the embroidery frame 9 are transported in the Y direction will be explained. The transport of the carriage 50 and the embroidery frame 9 in the Y direction is performed according to control by the CPU 61.

First, the coil of the first electromagnetic clutch 462 is energized, and the first drive gear 461 and the lead shaft 465 are caused to be in a state of rotating in an integrated manner. At this time, the coil of the second electromagnetic clutch 472 is not energized. As a result, the second drive gear 471 and the spline shaft 475 are not coupled and even if the second drive gear 471 rotates, the spline shaft 475 and the embroidery frame 9 do not rotate.

Then, the first motor 49 is driven and the drive gear 492 is rotated. The first drive gear 461 rotates in accordance with the rotation of the drive gear 492, and the lead shaft 465 rotates as a result of the same rotation. Thus, the helical groove portion 466 formed on the outer peripheral surface of the lead shaft 465 rotates. The pin 514 of the carriage 50, which engages with the groove portion 466, is transported in the Y direction along the groove portion 466, in accordance with the rotation of the groove portion 466. The pin 514 is fixed to the carriage 50, and thus, the entire carriage 50 is transported in the Y direction. As a result, the embroidery frame 9 is transported in the Y direction (the front-rear direction). When the lead shaft 465 rotates in the clockwise direction in a front view (the direction of an arrow 103 in FIG. 4), the carriage 50 and the embroidery frame 9 are transported toward the front. When the lead shaft 465 rotates in the anti-clockwise direction in the front view (in the direction of an arrow 104 in FIG. 4), the carriage 50 and the embroidery frame 9 are transported toward the rear.

As described above, the CPU 61 causes the lead shaft 465 to rotate by the determined rotation amount, and transports the embroidery frame 9 in the Y direction. When the lead shaft 465 rotates, the rotation amount of the lead shaft 465 is detected by the first encoder 401. The CPU 61 controls the rotation amount based on a rotation amount detection result detected by the first encoder 401, and thus rotates or stops the first motor 49. More specifically, the CPU 61 compares the rotation amount of the lead shaft 465 detected by the first encoder 401 (hereinafter referred to as a "detected rotation amount") with the determined rotation amount. When the detected rotation amount is smaller than the determined rotation amount, the CPU 61 continues to rotate the first motor 49. When the detected rotation amount and the determined rotation amount are the same, the CPU 61 stops the rotation of the first motor 49. By the above-described processing, the carriage 50 and the embroidery frame 9 are transported to and stopped at the accurate Y coordinate. Note that, when the carriage 50 is transported in the Y direction, the bushes 83 are pressed by the wall portion 516 that form the opening 515, and the worm 81 is transported in the Y direction in concert with the carriage 50.

An operation of the embroidery frame transport device 30 when the embroidery frame 9 is rotated will be explained. The rotation of the embroidery frame 9 is performed in accordance with control by the CPU 61. First, the coil of the second electromagnetic clutch 472 is energized and the second drive gear 471 and the spline shaft 475 are caused to be in a state of rotating in an integrated manner. At this time, the coil of the first electromagnetic clutch 462 is not energized. As a result, the first drive gear 461 and the lead shaft 465 are not coupled. In other words, only the first drive gear 461 rotates and the lead shaft 465 does not rotate, so the carriage 50 and the embroidery frame 9 are not transported in the Y direction.

The first motor 49 is driven and the drive gear 492 is caused to rotate. The second drive gear 471 rotates in accordance with the rotation of the drive gear 492, and the spline shaft 475 thus rotates. Due to the rotation of the spline shaft 475, the frame gear 934 rotates via the worm 81 and the worm wheel 82, and the embroidery frame 9 rotates. When the spline shaft 475 and the worm 81 are rotated in the clockwise direction in the front view (the direction of an arrow 105 in FIG. 4), the embroidery frame 9 is rotated in the clockwise direction in a plan view (the direction of an arrow 107 in FIG. 4). When the spline shaft 475 and the worm 81 are rotated in the anti-clockwise direction in the front view (the direction of an arrow 106 in FIG. 4), the embroidery frame 9 is rotated in the anti-clockwise direction in the plan view (the direction of an arrow 108 in FIG. 4).

As described above, the CPU 61 causes the spline shaft 475 to rotate by the determined rotation amount, and thus causes the embroidery frame 9 to rotate. When the spline shaft 475 is rotated, the rotation amount of the spline shaft 475 is detected by the second encoder 402. The CPU 61 controls the rotation amount based on a rotation amount detection result detected by the second encoder 402, and thus rotates or stops the first motor 49. More specifically, the CPU 61 compares the rotation amount of the spline shaft 475 detected by the second encoder 402 (the detected rotation amount) with the determined rotation amount. When the detected rotation amount is smaller than the determined rotation amount, the CPU 61 continues to rotate the first motor 49. When the detected rotation amount and the determined rotation amount are the same, the CPU 61 stops the rotation of the first motor 49. By the above-described processing, the embroidery frame 9 is rotated to and stopped at an accurate rotation angle.

An operation of the embroidery frame transport device 30 when the embroidery frame 9 is transported in the X direction will be explained. The transport of the carriage 50 and the embroidery frame 9 in the X direction is performed in accordance with control by the CPU 61.

First, the second motor 27 is driven and the drive gear 271 is driven. The large diameter gear 244 and the pulley 245 rotate in accordance with the rotation of the drive gear 271. The timing belt 246 moves in accordance with the rotation of the pulley 245. The auxiliary frame 243 is transported in the X direction along the guide shaft 241 and the guide member 242 in accordance with the movement of the timing belt 246. As a result, the Y direction frame 44 that is connected to the auxiliary frame 243 is transported in the X direction and the embroidery frame 9 is transported in the X direction. The CPU 61 causes the second motor 27 to rotate by the determined rotation amount and then stops the second motor 27.

The transport and the rotation of the embroidery frame 9 of the present embodiment are performed as described above. In the present embodiment, the transport of the embroidery frame 9 in the Y direction and the rotation of the embroidery frame 9 can be performed by the first drive mechanism 45. Further, the first drive mechanism 45 is not provided on the carriage 50. As a result, the weight of the carriage 50 can be reduced. Thus, when the first drive mechanism 45 transports the carriage 50 in the Y direction, it becomes easier for the carriage 50 to stop. It is therefore possible to improve the accuracy of the stop position of the embroidery frame 9 and the carriage 50.

Further, the transport of the carriage 50 by the first transport mechanism 46 and the rotation of the embroidery frame 9 by the rotation mechanism 47 can be performed by the single first motor 49. As a result, in comparison to a case in which two motors are used to drive the first transport mechanism 46 and the rotation mechanism 47, it is possible to reduce the number of motors, and costs can be reduced. In addition, the heavy first motor 49 is provided separately from the carriage 50 and it therefore becomes easier for the carriage 50 to stop. It is thus possible to improve the accuracy of the stop position of the embroidery frame 9 and the carriage 50.

Additionally, in comparison to a case in which the first motor 49 is provided on the carriage 50, as well as being possible to reduce the weight of the carriage 50, it is possible to downsize the carriage 50. As a result, the carriage 50 is less likely to deform. It is thus possible to inhibit an impact on the sewing or the cut work as a result of deformation of the carriage 50. Further, as the first motor 49 is not provided on the embroidery frame 9, it is possible to reduce the costs of the embroidery frame 9 itself.

Further, the transport of the carriage 50 in the Y direction and the support of the carriage 50 can be performed using the lead shaft 465. As a result, in comparison to a case in which the transport of the carriage 50 in the Y direction and the support of the carriage 50 are performed by separate members, it is possible to reduce the number of components and to reduce costs.

The spline shaft 475 supports the carriage 50 such that the carriage 50 can move. Further, the embroidery frame 9 rotates by the spline shaft 475 rotating. Therefore, in comparison to a case in which the support of the carriage 50 and the rotation of the embroidery frame 9 are performed by separate members, it is possible to reduce the number of components and to reduce costs.

Moreover, the first electromagnetic clutch 462 switches between the transmission and the shutting off of the rotary force resulting from the driving of the first motor 49, and thus controls the rotation and the stopping of the lead shaft 465. The second electromagnetic clutch 472 switches between the transmission and the shutting off of the rotary force resulting from the driving of the first motor 49, and thus controls the rotation of the stopping of the spline shaft 475. As a result, in comparison to a case in which the transmission and the shutting off of the rotary force resulting from the driving of the first motor 49 is performed by another complex mechanism, without using the first electromagnetic clutch 462 and the second electromagnetic clutch 472, it is possible to downsize the first drive mechanism 45.

In addition, it is possible to control the rotation amounts of the lead shaft 465 and the spline shaft 475 based on the detection results of the first encoder 401 and the second encoder 402. Therefore, as well as transporting the embroidery frame 9 to the accurate Y coordinate, it is possible to rotate the embroidery frame 9 to the accurate rotation angle.

Further, it is possible to transport the embroidery frame 9 in the X direction by the second drive mechanism 23 transporting the first drive mechanism 45 in the X direction. More specifically, it is possible to transport the first drive mechanism 45 in the X direction, and to transport the embroidery frame 9 in the X direction by the second motor 27 driving the second transport mechanism 24.

It should be noted that the present disclosure is not limited to the above-described embodiment and various modifications are possible. For example, the rotation of the lead shaft 465 and the spline shaft 475 are controlled based on the detection results of the first encoder 401 and the second encoder 402 provided in the rotation detection portion 40, but the present disclosure is not limited to this example. For example, the rotation detection portion 40 need not necessarily be provided, and the rotation of the lead shaft 465 and the spline shaft 475 may be controlled by driving the first motor 49 such that the lead shaft 465 and the spline shaft 475 are driven by the determined rotation amount.

Further, the rotation and the stopping of the lead shaft 465 and the spline shaft 475 is controlled by the first electromagnetic clutch 462 and the second electromagnetic clutch 472, but the present disclosure is not limited to this example. For example, a gear that is coupled to the lead shaft 465 and a gear that is coupled to the spline shaft 475 may be provided, and the control of the rotation and the stopping of the lead shaft 465 and the spline shaft 475 may be performed by switching between a state of contact and a state of non-contact between the provided gears and the drive gear 492.

In the above-described embodiment, the transport of the embroidery frame 9 in the Y direction and the rotation of the embroidery frame 9 are performed as separate operations, but the first electromagnetic clutch 462 and the second electromagnetic clutch 472 may both be energized at the same time and the movement of the embroidery frame 9 in the Y direction and the rotation of the embroidery frame 9 may be performed simultaneously.

Further, the configuration of the first drive mechanism 45 is not limited. As long as it is a mechanism that transports the carriage 50 in the Y direction and causes the embroidery frame 9 supported by the carriage 50 to rotate, another configuration may be used.

What is claimed is:

1. An embroidery frame transport device comprising:

a carriage that rotatably supports an embroidery frame and that is capable of moving in a first direction; and a first drive mechanism that is provided separately from the carriage, that transports the carriage in the first direction and that causes the embroidery frame supported by the carriage to rotate, wherein:

the first drive mechanism includes:

a first transport mechanism that transports the carriage in the first direction, a rotation mechanism that causes the embroidery frame to rotate, a first motor that drives the first transport mechanism and the rotation mechanism, and a first shaft that extends in the first direction and supports the carriage, and that transports the carriage in the first direction when the first shaft rotates as a result of driving of the first motor, the rotation mechanism includes:

a second shaft that is arranged in parallel to the first shaft, that movably supports the carriage and that rotates as a result of the driving of the first motor, and a first gear that is arranged around the second shalt, the first gear rotating in accordance with rotation of the second shaft, and moving in the first direction in concert with the carriage that is transported by the first shaft, the carriage includes a third gear that meshes with a second gear formed around an outer peripheral surface of the embroidery frame and with the first gear, and the embroidery frame is rotated by rotation of the second gear via the first gear and the third gear, when the second shaft rotates as a result of rotation of the first motor.

2. The embroidery frame transport device according to claim 1, wherein the first drive mechanism includes an electromagnetic clutch that switches between transmission and shutting off of a rotary force resulting from the driving of the first motor, and that is capable of controlling rotation and stopping of at least one of the first shaft and the second shaft.

3. The embroidery frame transport device according to claim 2, further comprising:

a detection mechanism that detects a rotation amount of each of the first shaft and the second shaft, wherein the first motor is rotated or stopped based on a detection result of the rotation amount detected by the detection mechanism.

4. The embroidery frame transport device according to claim 1, further comprising:

a detection mechanism that detects a rotation amount of each of the first shaft and the second shaft, wherein the first motor is rotated or stopped based on a detection result of the rotation amount detected by the detection mechanism.

5. The embroidery frame transport device according to claim 1, further comprising:

a second drive mechanism that transports the first drive mechanism in a second direction that is different to the first direction.

6. The embroidery frame transport device according to claim 5, wherein the second drive mechanism includes a second transport mechanism that transports the first drive mechanism in the second direction, and a second motor that drives the second transport mechanism.

7. A sewing machine comprising:

a bed portion that is formed such that an embroidery frame transport device can be mounted thereon, the embroidery frame transport device including a carriage that rotatably supports an embroidery frame and that is capable of moving in a first direction, and a first drive mechanism that is provided separately from the carriage, that transports the carriage in the first direction and that causes the embroidery frame supported by the carriage to rotate, wherein:

the first drive mechanism includes:

a first transport mechanism that transports the carriage in the first direction, a rotation mechanism that causes the embroidery frame to rotate, a first motor that drives the first transport mechanism and the rotation mechanism, and a first shaft that extends in the first direction and supports the carriage, and that transports the carriage in the first direction when the first shaft rotates as a result of driving of the first motor, the rotation mechanism includes:

a second shaft that is arranged in parallel to the first shaft, that movably supports the carriage and that rotates as a result of the driving of the first motor, and a first gear that is arranged around the second shaft, the first gear rotating in accordance with rotation of the second shaft, and moving in the first direction in concert with the carriage that is transported by the first shaft, the carriage includes a third gear that meshes with a second gear formed around an outer peripheral surface of the embroidery frame and with the first gear, and the embroidery frame is rotated by rotation of the second gear via the first gear and the third gear, when the second shaft rotates as a result of rotation of the first motor.

* * * * *